US006098411A

United States Patent [19]

Jeon

[11] Patent Number: 6,098,411

[45] Date of Patent: Aug. 8, 2000

[54] RETRACTABLE TYPE TEMPERATURE CONTROL PANEL APPARATUS FOR REFRIGERATOR

[75] Inventor: Gu Pyo Jeon, Kyungsangnam-Do, Rep. of Korea

[73] Assignee: LG Electronics Inc., Seoul, Rep. of Korea

[21] Appl. No.: 08/393,707

[22] Filed: Feb. 24, 1995

[30] Foreign Application Priority Data

Feb. 24, 1994 [KR] Rep. of Korea ..... 94-3402

[51] Int. Cl.[7] ..... F25B 49/02

[52] U.S. Cl. ..... 62/125; 236/94

[58] Field of Search ..... 236/94; 62/125, 62/126, 127, 129, 130; 165/11.1; 200/293, 296, 308

[56] References Cited

U.S. PATENT DOCUMENTS 4,014,178 3/1977 Kells ..... 62/125 X
4,404,813 9/1983 Paddock et al. ..... 62/127
4,646,528 3/1987 Marcade et al. ..... 236/94 X
4,936,106 6/1990 Beach, Jr. et al. ..... 200/293 X
4,966,004 10/1990 Midlang et al. ..... 62/125 X

FOREIGN PATENT DOCUMENTS 145561 12/1980 Germany ..... 62/125

*Primary Examiner*—Harry B. Tanner
*Attorney, Agent, or Firm*—Fliesler, Dubb, Meyer & Lovejoy

[57] ABSTRACT

A retractable type temperature control panel apparatus for a refrigerator capable of advantageously preventing malfunctions thereof caused by inadvertent contact with a temperature control section thereof, which includes, in a freezer compartment door of a refrigerator, having a curved and elongated rear wall and having a pair of end walls; a downwardly and forwardly opened rotation guide member engaged to the recess and having a curved and elongated rear wall and a pair of end walls each having hinge openings therein; a triangular section rotation member rotatably engaged to the rotation guide member by a pair of hinge pin protrusions formed on each end thereof and having a front surface, a bottom surface and a rear surface; and a temperature control switch plate engaged to a temperature control switch groove formed on the front surface of the rotation member and having a plurality of temperature control switches carried thereon.

5 Claims, 4 Drawing Sheets

RETRACTABLE TYPE TEMPERATURE CONTROL PANEL APPARATUS FOR REFRIGERATOR

BACKGROUND OF THE INVENTION

1. Field of the Invention

The present invention relates to a retractable type temperature control panel apparatus for a refrigerator, and particularly to a retractable type temperature control panel apparatus for a refrigerator capable of advantageously preventing malfunctions thereof caused by inadvertent contact with a temperature control section thereof.

2. Description of the Conventional Art

Conventionally, referring to FIG. 1, there is provided a freezer compartment door 20 on a refrigerator body 10 for opening/closing a freezer compartment(not shown). A refrigerator compartment door 30 is provided on the lower portion of the refrigerator body 10 for opening/closing a refrigerator compartment(not shown). A temperature control panel section 40 is provided on a predetermined portion of the freezer compartment door 20 for controlling the temperature in the freezer compartment. A plurality of temperature control switches 50 are provided on the front surface of the temperature control panel section 40. In addition, a doorhandle 60 is provided on a predetermined portion of the front surface of the freezer compartment door 20.

Referring to FIG. 2, the construction of the conventional temperature control panel section of a refrigerator will now be explained.

To begin with, a downwardly and forwardly opened recess section 70 having a rear wall 70*a* and a pair of side walls formed on each end thereof is formed in a predetermined portion of the freezer compartment door 20. A connecting cable 95 is provided in a predetermined portion of the rear wall 70*a*, one end of which is connected to a microcomputer(not shown) provided on a predetermined portion of the refrigerator and the other end of which is provided with a connector 95*a*.

An inverted T-shaped profile support member 80 having an upwardly extended affixing section 81, a rearwardly extended section 82 and a forwardly extended section 83 is engaged in the recess 70. Here, a plurality of screw openings 90*a* are formed through affixing section 81.

A substantially elongated flat plate-shaped temperature control panel section 40 carrying a plurality of temperature control switches 50 therein and provided therethrough with a plurality of screw openings 90*b* formed in the surface thereof is placed on the front surface of the support member 80. A connecting cable 96 having a connector 96*a* is provided at a predetermined portion of the rear surface of the temperature control panel 40. Here, the connector 96*a* is electrically connected to the connector 95*a*.

The description of the conventional temperature control panel of the refrigerator will now be provided.

To begin with, the support member 80 and the temperature control panel section 40 are respectively affixed to a predetermined portion of the freezer compartment door 20 using screws inserted the screw openings 90*a* and 90*b*.

A user controls a temperature control switch 50 for setting the temperature to a predetermined level, whereby the temperature in the freezer compartment which is previously set thereby is maintained to a predetermined level with cooperation of a sensor(not shown) and the microcomputer which are provided therein.

However, the conventional temperature control panel section for the refrigerator may cause malfunctions of the refrigerator due to being inadvertently contacted by the user or child because the temperature control panel is provided exposed on the front surface of the freezer compartment door 20, so that a predetermined temperature level can not be achieved due to the above malfunctions.

SUMMARY OF THE INVENTION

Accordingly, it is an object of the present invention to provide a retractable type temperature control panel apparatus for a refrigerator.

It is another object of the present invention to provide a retractable type temperature control panel apparatus for a refrigerator capable of advantageously preventing malfunctions thereof caused by inadvertent contacts to a temperature control section thereof.

To achieve the above objects, there is provided a retractable type temperature control panel apparatus for a refrigerator, which includes, in a freezer compartment door of a refrigerator, a downwardly and forwardly opened recess formed in a predetermined portion of the freezer compartment door and having a curved and elongated rear wall and having a pair of end walls; a downwardly and forwardly opened rotation guide member engaged to the recess and having a curved and elongated rear wall and a pair of end walls each having hinge openings thereon; a triangular section rotation member rotatably engaged to the hinge opening of the rotation guide member by a pair of hinge pin protrusions formed on each end thereof and having a front surface, a bottom surface and a rear surface; and a temperature control switch plate engaged to a temperature control switch opening formed on the front surface of the rotation member and having a plurality of temperature control switches provided thereon.

DETAILED DESCRIPTION OF THE INVENTION

Figure 1:
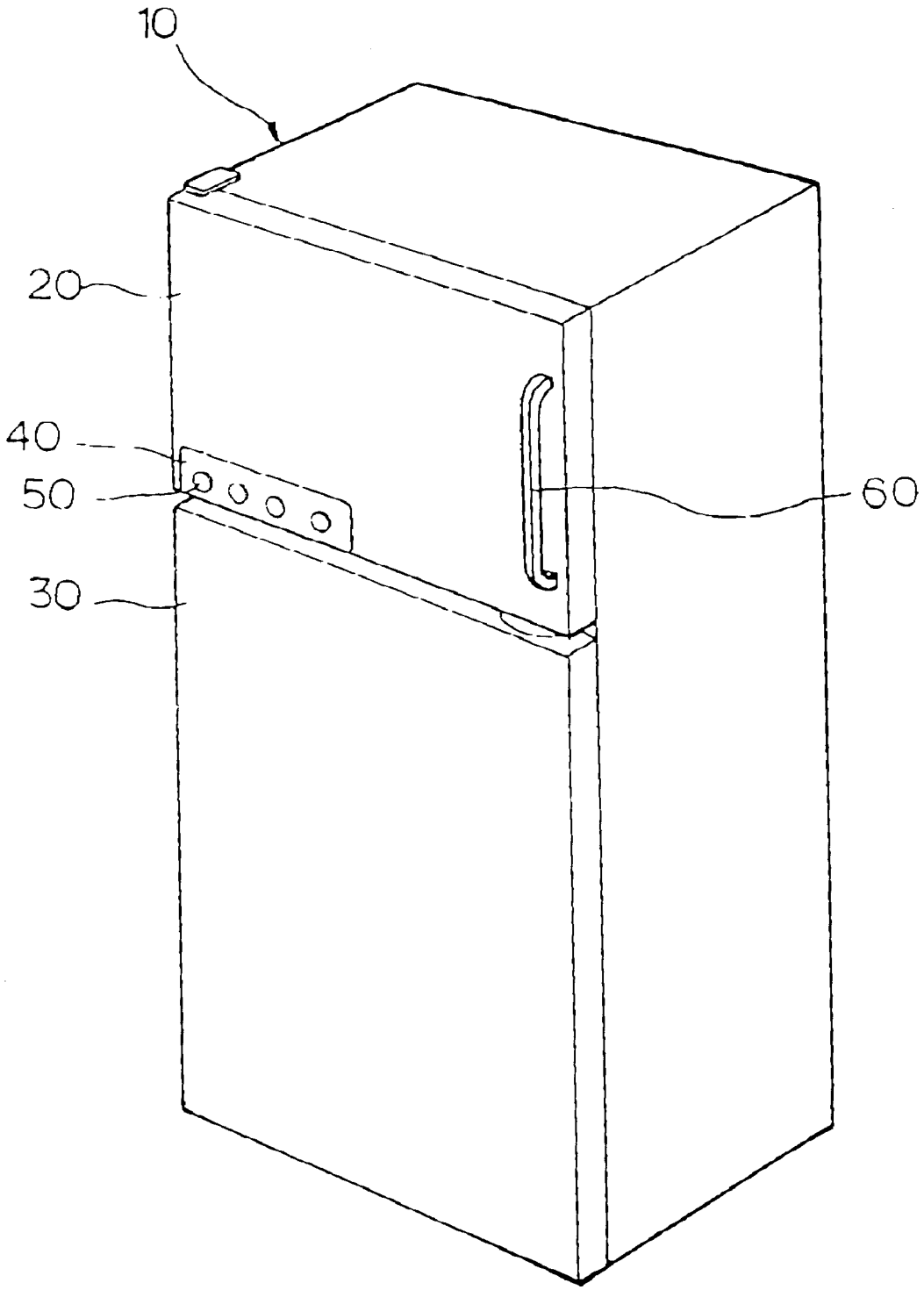
FIG. 1 CONVENTIONAL ART
FIG. 1 is a perspective view showing a construction of a conventional refrigerator equipped with a temperature control panel section.
Figure 2:
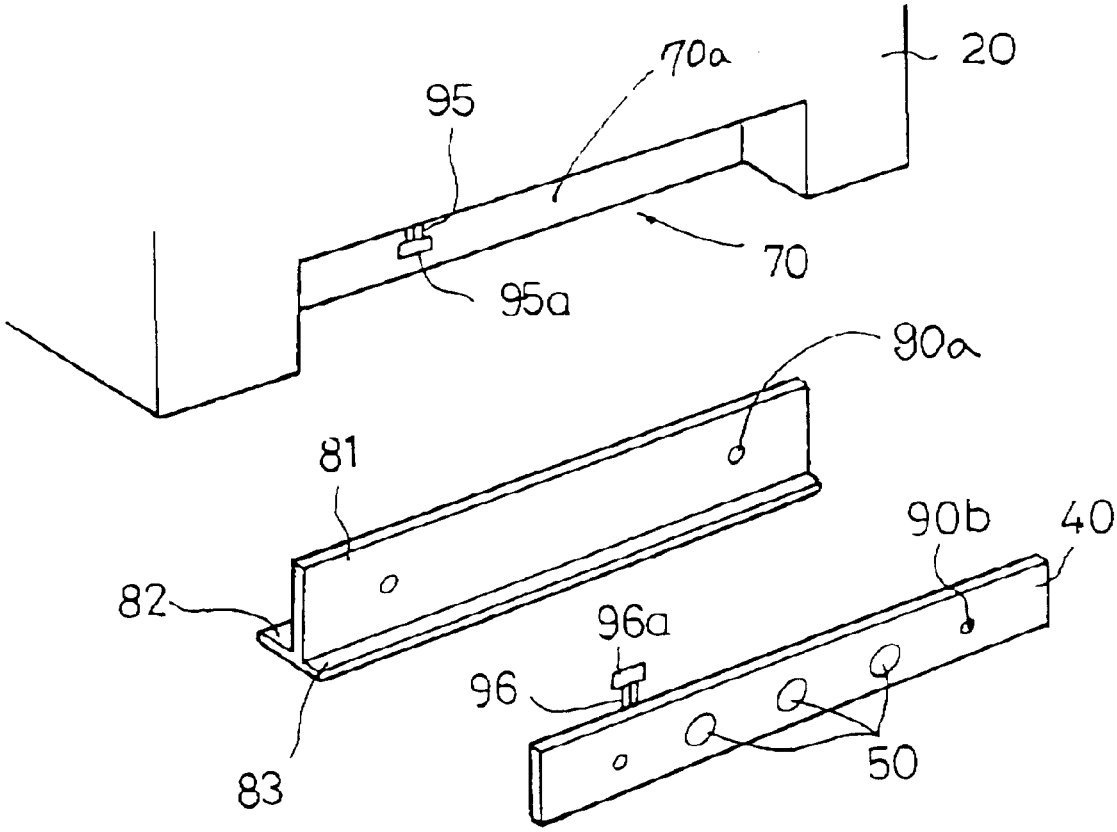
FIG. 2 CONVENTIONAL ART
FIG. 2 is a perspective view showing a construction of the conventional temperature control panel section of a refrigerator.
Figure 3:
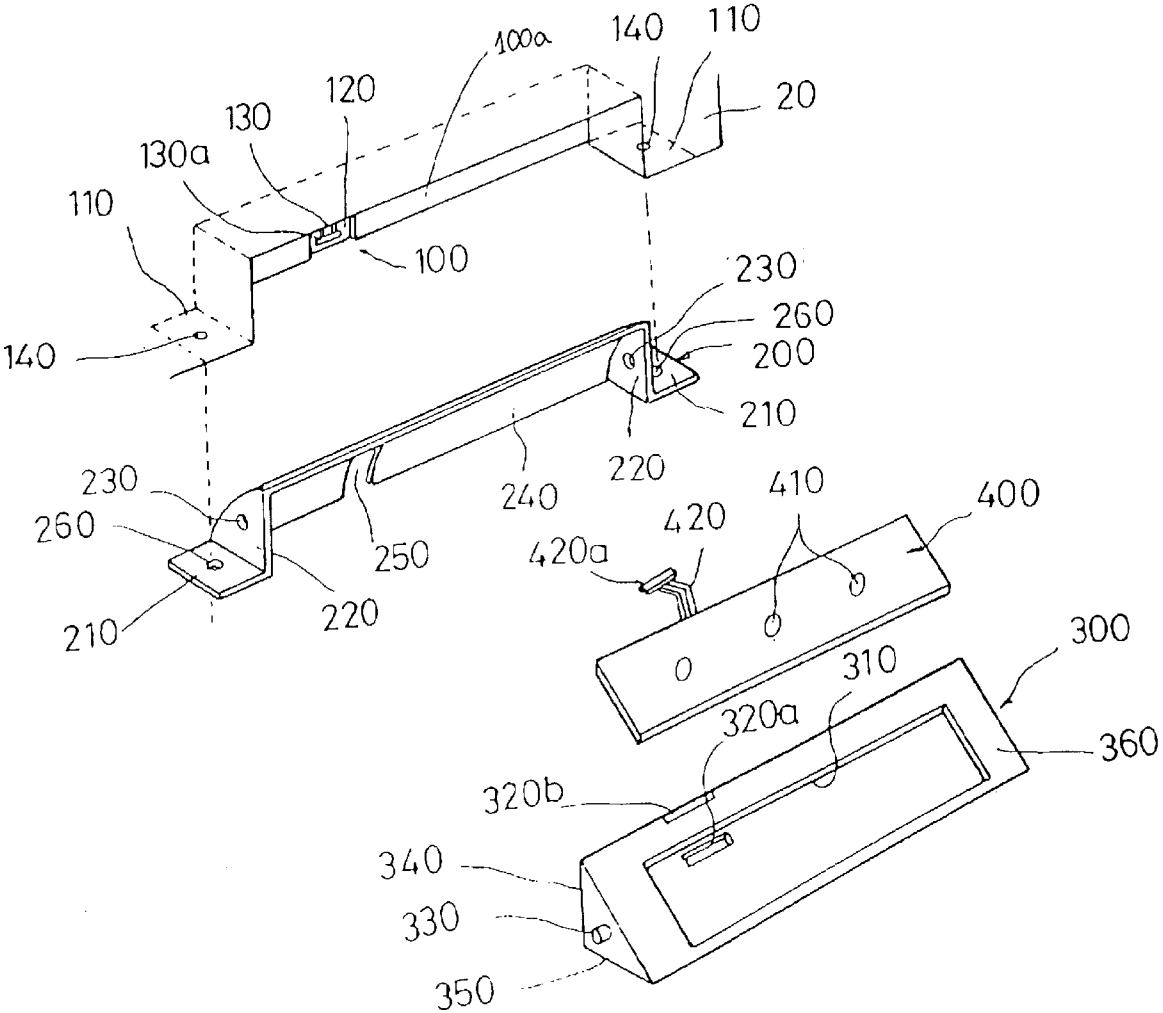
FIG. 3 is a perspective view showing a construction of a retractable type temperature control panel apparatus for a refrigerator according to the present invention.

Referring to FIG. 3, formed in a predetermined portion of a freezer compartment door 20 of a refrigerator, there in provided a forwardly and downwardly opened and horizontally elongated recess 100 having a curved rear wall 100*a*, a pair of end walls, and a pair of screw openings 140 are formed in an underside of the freezer compartment door 20 at spaced apart from each end wall of recess 100. A forwardly and downwardly opened groove 120 is formed on a predetermined portion of the rear wall 100*a*. A connecting cable 130 having a connector 103*a* provided on one end thereof, the other end of which is connected to a microcomputer(not shown) is extended into the groove 120.

A forwardly and downwardly opened rotation guiding member 200 having a curved and horizontally elongated rear wall 240, a pair of end walls 220 each having a hinge opening 230 formed therein, and a pair of angled tab extensions 210 extending from end walls 220 and each having a screw opening 260 thereon is engaged in the recess section 100. A connecting cable guide groove 250 is formed in a predetermined portion of the rear wall 240 for guiding the connecting cable 130.

A triangular section rotation member 300 having a rear surface 340, a bottom surface 350 and a front surface 360 having a temperature control switch opening 310 formed thereon is also provided with a pair of ends each having a hinge pin protrusion 330 which is respectively rotatably fitted into the hinge openings 230 of rotation guide member 200. A first connecting cable opening 320*a* and a second connecting cable opening 320*b* are formed in a predetermined portion of the front surface 360 of the rotation member 300 for receiving the connecting cables 130 and 420 therethrough.

A temperature control switch plate 400 having a plurality of temperature control switches 410 carried therein is fitted to the temperature control switch opening 310. A connecting cable 420 having a connector 420*a* provided on one end thereof and the other end of which is connected to each temperature control switch 410 is extended from the switch plate 400 from the connector 130*a* is electrically connected to the connector 422*a*.

Figure 4A:
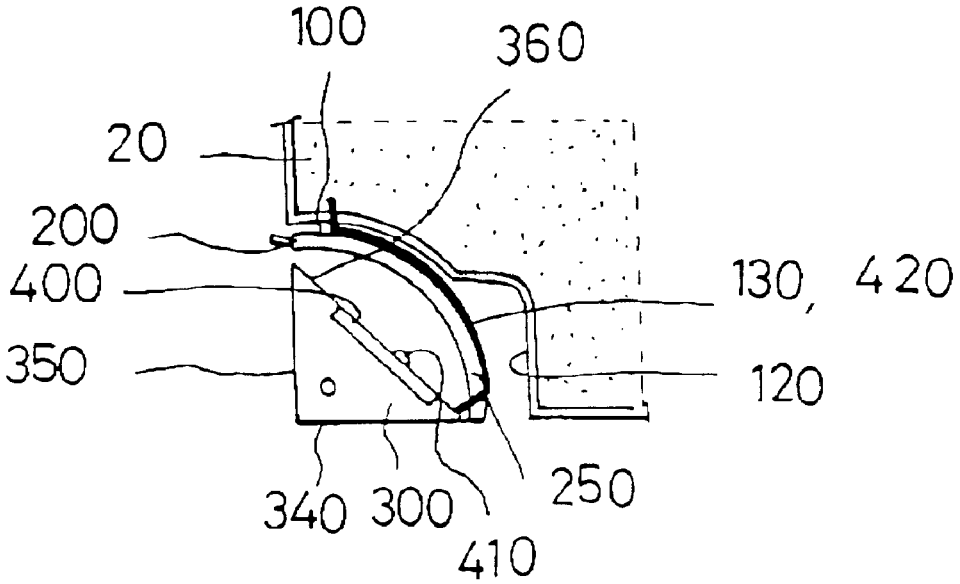
FIG. 4A is a cross-sectional view showing the retrctable type temperature control panel apparatus according to the present invention in a retraced state.
Figure 4B:
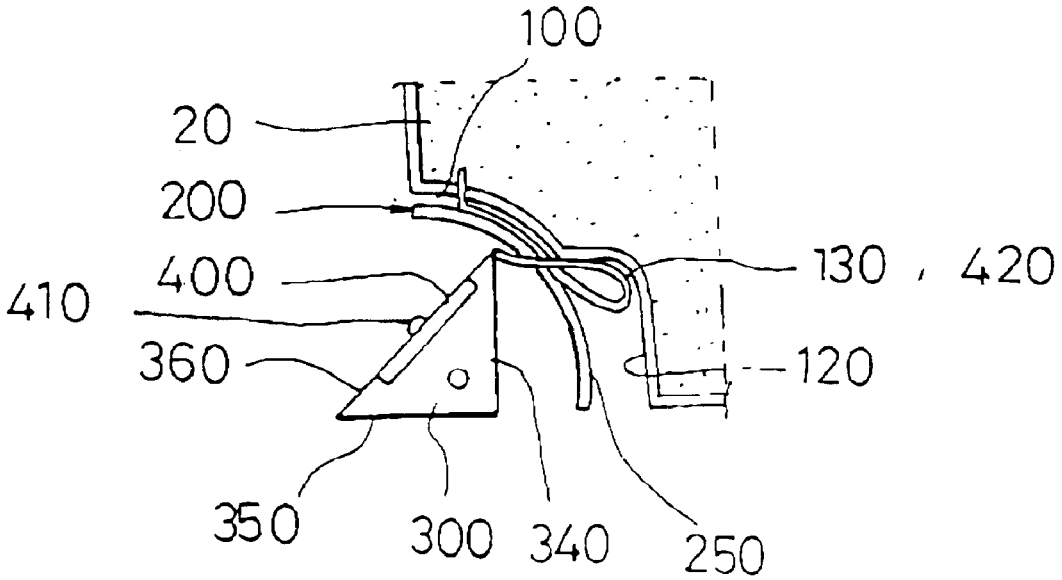
FIG. 4B is a cross-sectional view showing the retractable type temperature control panel apparatus according to the present invention in its un-retracted state for use.

The operation of the retractable type temperature control panel apparatus for a refrigerator will now be explained with reference to FIGS. 4A to 4B.

To begin with, the rotation member 300 is rotatably fitted to the rotation guiding member 200. At this time, the front surface 360 of the rotation member 300 faces to the rear wall of the rotation guide member 200, so that the bottom surface 350 is flash with the front surface of the freezer compartment door 20.

When a user rotates the rotation member 300 by pushing a predetermined portion of the bottom surface 350 in order to access the temperature control switches 410, the rotation member 300 turns counterclockwise, so that the front surface 360 becomes exposed with the front surface of the freezer compartment door 20. Thereafter, the user can set the temperature control switch 410 to a predetermined level, so that the temperature in the refrigerator is maintained in cooperation with a sensor(not shown) and a microcomputer (not shown) which are provided in a predetermined portion in the refrigerator.

After handling the temperature control switches 410, the user pushes a predetermined portion of the front surface 360 of the rotation member 300 in order to turn the rotation number 300 clockwise, so that the front surface 360 thereof faces to the rear wall of the 240 of the rotation guide member 200.

Meanwhile, during the rotation of the rotation member 300, the connecting cables 130 and 420 are guided by the connecting guide groove 250 and the groove 120.

As described above, the present invention is directed to a retractable type temperature control panel apparatus for a refrigerator capable of advantageously preventing malfunctions thereof caused by inadvertent contact with a temperature control panel section thereof by adapting a retractable type temperature control panel apparatus.

What is claimed is:

1. A retractable type temperature control panel apparatus for a refrigerator, comprising:

in a freezer compartment door of a refrigerator, a downwardly and forwardly opened recess having a curved and elongated rear wall and a pair of end walls;

downwardly and forwardly opened rotation guide means engaged to the recess and having a curved and elongated rear wall and a pair of end walls each having hinge openings formed therein;

triangular section rotation means rotatably engaged to the rotation guide means by a pair of hinge pin protrusions formed on each end thereof and having a front surface, a bottom surface and a rear surface; and a temperature control switch plate engaged to a temperature control switch opening formed on the front surface of the rotation means and having a plurality of temperature control switches carried thereon.

2. The apparatus of claim 1, wherein on a predetermined portion of the rear wall of said recess section is provided a connecting cable having a connector provided on one end thereof.

3. The apparatus of claim 1, wherein said rotation guide means includes a connecting cable guide groove formed on a predetermined portion of the rear wall thereof for guiding connecting cables.

4. The apparatus of claim 1, wherein said front surface of said triangular column-shaped rotation means includes a first opening and a second opening which are formed in a predetermined portions thereof for receiving connecting cables therethrough.

5. The apparatus of claim 1, wherein said temperature control switch plate includes a connecting cable provided on the back surface thereof and having a connector provided on one end thereof electrically connected to a connector of a connecting cable and the other end of which is connected to each temperature control switch.

* * * * *